United States Patent [19]

Meyn

[11] Patent Number: 4,645,058

[45] Date of Patent: Feb. 24, 1987

[54] APPARATUS FOR ORIENTING EGGS IN A EGG HANDLING SYSTEMS

[76] Inventor: Pieter Meyn, Noordeinde 68C, 1511 AE Oostzaan, Netherlands

[21] Appl. No.: 830,244

[22] Filed: Feb. 18, 1986

Related U.S. Application Data

[63] Continuation of Ser. No. 535,302, Sep. 23, 1983, abandoned.

[30] Foreign Application Priority Data

Sep. 24, 1982 [NL] Netherlands ..... 8203705

[51] Int. Cl.[4] ..... B65G 47/24

[52] U.S. Cl. ..... 198/400

[58] Field of Search ..... 198/400, 406, 399, 384; 53/446

[56] References Cited

U.S. PATENT DOCUMENTS

| | | | |
|---|---|---|---|
| 2,919,787 | 1/1960 | Reck et al. | 198/400 |
| 3,316,688 | 5/1967 | Niederer et al. | 198/652 |
| 3,342,012 | 9/1967 | Reading | 198/400 |
| 3,592,327 | 7/1971 | Koch et al. | 198/400 |
| 3,820,301 | 6/1974 | Willsey | 198/399 |
| 3,964,233 | 6/1976 | Thomas | 53/446 |
| 4,189,898 | 2/1980 | Moulds et al. | 53/446 |
| 4,366,896 | 1/1983 | Tomosue | 198/384 |

FOREIGN PATENT DOCUMENTS 132757 6/1971 Netherlands .

*Primary Examiner*—Joseph E. Valenza
*Assistant Examiner*—Daniel R. Alexander
*Attorney, Agent, or Firm*—Dority & Manning

[57] ABSTRACT

An apparatus for orienting eggs in an egg handling system comprises an endless roller chain for conveying the eggs to be oriented along a track defined between parallel longitudinally extending vertical guide plates arranged above the roller chain. At the downstream end of the roller chain an orienting member is suspended for free swinging movement about a horizontal axis extending downwardly to within the path of the advancing eggs. The orienting member has two guide edges facing the roller chain which guide edges at the level where the advancing edges first meet the orienting member, have a lateral spacing and position such that each egg is initially engaged adjacent its acute end by one of the two guide edges whereas the blunt end of the egg is permitted to slide downwards along the other one of the guide eggs whereby the egg is caused to swing around to a position in which its blunt end faces downwards, the guide edges converging downwardly to a relative lateral spacing which is smaller than the thickest part of the eggs to be oriented.

16 Claims, 6 Drawing Figures

APPARATUS FOR ORIENTING EGGS IN A EGG HANDLING SYSTEMS

This is a continuation of application Ser. No. 535,302 filed Sept. 23, 1983 which was abandoned upon the filing hereof.

BACKGROUND OF THE INVENTION

The invention relates to egg handling systems and more particularly to an apparatus for orienting eggs for use in such a system.

Apparatuses for orienting eggs are, for instance, used in machines for grading and/or packaging eggs and similar egg handling systems where it is required that all the eggs supplied initially to the machine in random positions be uniformly oriented with their blunt ends facing in the same direction, such as the direction of forward movement of the eggs through the machine, before being further processed. A known type of egg orienting apparatus, as for instance described in applicant's prior U.S. patent application Ser. No. 504,526, filed June 15, 1983, comprises egg conveying means including a driven endless roller chain having a plurality of equally spaced rollers adapted to support successive eggs therebetween which rollers are rotated about their axes while the chain advances the eggs whereby the eggs will be shifted laterally in the direction of their acute ends in a manner well-known. Longitudinally extending vertical guide plates are arranged above the roller chain to define a track for the eggs therebetween of a width greater than the length of the eggs to be processed, which guide plates thus limit the lateral movement of the eggs in the one or the other direction caused by their rotation. The guide plates have at their downstream ends adjacent the end of the track a projection or stop projecting laterally into the track whereby the eggs advancing through the track with their acute ends sliding along the one or the other of the guide plates will, when reaching the end of the track, contact with their acute end the stop on the guide plate concerned and will thereby be swung around to a position with their longitudinal axes generally directed perpendicularly to the rollers of the chain with their blunt ends facing forwardly and downwardly to be caught in a receiving cup member or the like. This type of egg orienting apparatus has the disadvantage that the stops projecting inwardly into the track from the guide plates decrease the width of free passage for the eggs whereby eggs of large size may get stuck. According to another known egg orienting device as disclosed in the Netherlands Pat. No. 132,757, the rotating rollers of the moving roller chain have enlarged ends to limit the lateral displacement of the eggs supported on these rollers and a downwardly sloping chute member arranged immediately downstream of the roller chain which chute has converging side walls such that the eggs are caused to slide down the chute with their blunt ends forwardly towards a midposition to be received by a second roller chain. Movable detaining means are provided to engage the successive eggs reaching the chute and to brake their falling movement. This known orienting device has the disadvantage of a complicated and costly structure requiring much space. The presence of the detaining means prevents the second roller chain from being arranged closely downstream of the first roller chain whereby the height of fall of the eggs is still relatively great with the consequent risk of damage to the egg shells.

SUMMARY OF THE INVENTION

It is accordingly an object of the present invention to provide an egg orienting apparatus which obviates the drawbacks of the known devices of this kind.

More particularly, it is an object of the invention to provide such an egg orienting apparatus which performs its function quickly and effectively and which guides the oriented eggs to the receiving means therebelow, such as an egg receiving cup, without risk of damage to the egg shells.

A further object of the invention is to provide an egg orienting apparatus of simple design which requires only little mounting space, is easily adjustable and needs no separate driving means.

The egg orienting apparatus of the invention generally comprises an elongate egg orienting member arranged at the downstream end of the track formed by a driven endless roller chain or a similar egg conveying means. The upper end of the orienting member is pivotally mounted above the end of the track and has a downwardly extending lower portion which in the rest position of the member extends obliquely forwardly and downwardly across and spaced from the end of the track, the member being free to swing upwardly and forwardly from this rest position. The lower portion of the orienting member comprises two guide edges facing the track and having, at the level where the advancing eggs first contact these edges, a lateral distance and position such that the eggs with their acute end portions abut one of the two guide edges and the blunt end of the eggs is permitted to slide downwards along the other one of the guide edges, whereby the eggs are caused to swing to a position in which their blunt end faces downwards. The guide edges converge downwardly to a relative lateral distance which is smaller than the thickest part of the eggs to be oriented. The advancing eggs successively contact the orienting member to be swung around thereby through approximately 90° to a position with their blunt end facing forwardly, the egg then being guided by the converging guide edges in a downward path between the end of the track or roller chain and the orienting member swinging backwards in which the orienting member brakes the falling movement of the egg. Because the orienting member requires substantially no extra space, the receiving means, such as a cup-shaped holder, can be arranged closely downstream of the roller chain with its upwardly facing opening substantially at the level of the axis of the terminal pulley means of this chain, whereby the height of fall of the eggs becomes very short preventing damage to the egg shells.

The orienting member may be fork-shaped and comprise two guide rod members forming the guide edges. According to an other embodiment, however, the orienting member comprises a plate of spoon-like configuration having turned-over side edge parts to form the guide edges.

BRIEF DESCRIPTION OF THE DRAWINGS

The present invention will be more readily understood and the further objects and advantages thereof will be more apparent when read in conjunction with the accompanying drawings in which.

DETAILED DESCRIPTION OF THE PREFERRED EMBODIMENTS

Figure 1:
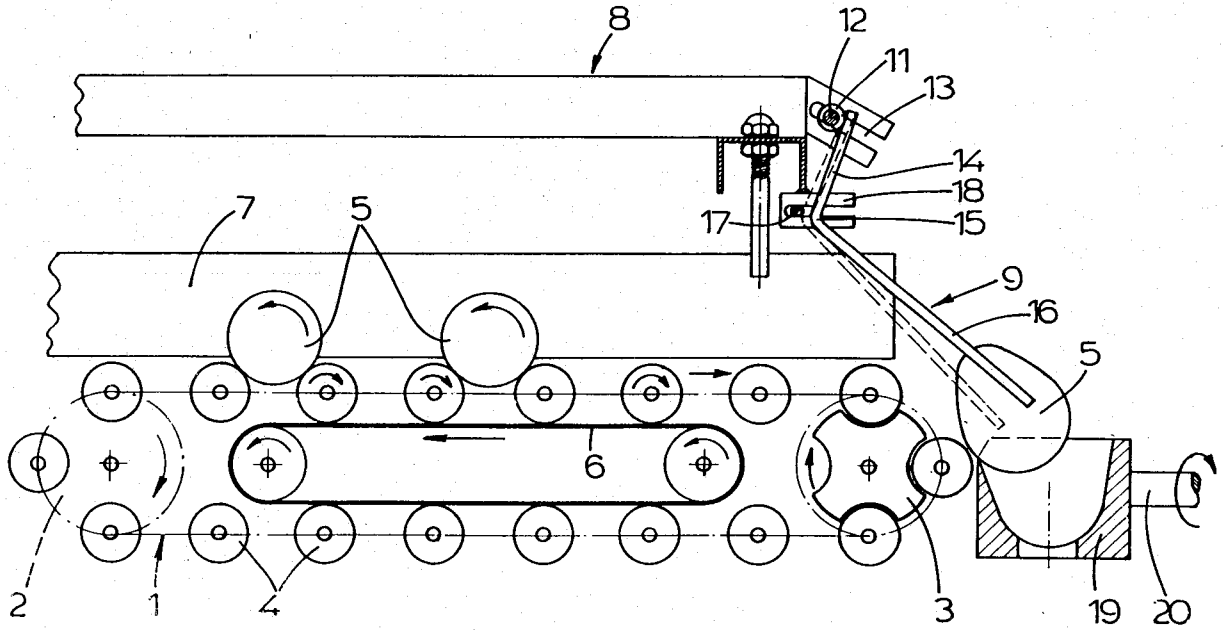
FIG. 1 is a vertical longitudinal section of the apparatus of the invention having an orienting member according to a first preferred embodiment.
Figure 2:
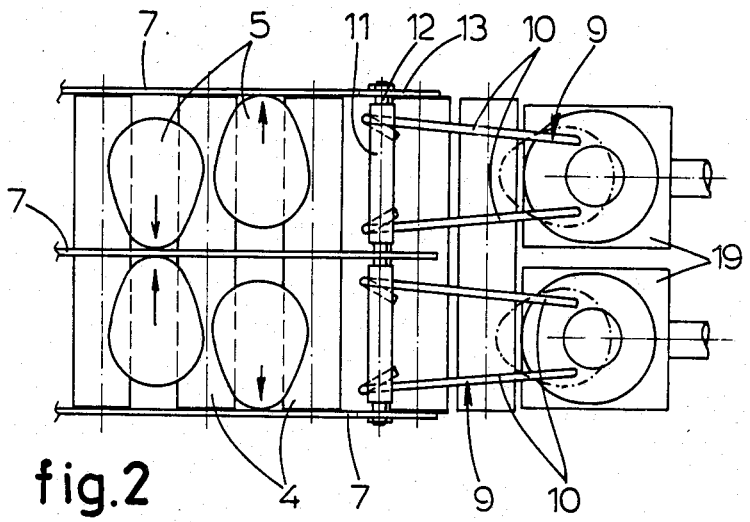
FIG. 2 is a plan view of part of the apparatus of FIG. 1 in which the upper frame of the apparatus has been left out for a better view of the underlying parts.
Figure 3:
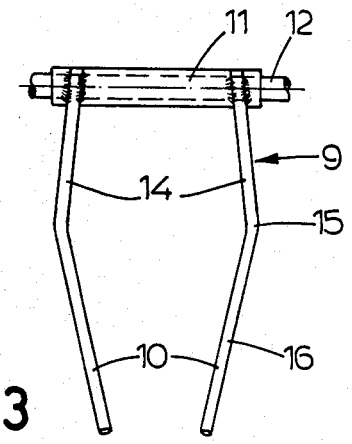
FIG. 3 is a front elevational view of the orienting member of the apparatus of FIG. 1.

Referring to FIGS. 1, 2 and 3 of the drawings, the egg orienting apparatus there shown comprises a driven endless roller chain 1 of known design which passes around a front terminal pulley means 2 and a rear terminal pulley means 3 of star wheel configuration, the roller chain being driven in the direction of the arrow shown in FIG. 1, thus with its upper part moving from left to right as seen in FIG. 1. As appears from FIG. 2, the apparatus may have two (or more) similar parallel roller chains together forming a single chain unit. Each roller chain 1 comprises a number of equally spaced transversely extending supporting rollers 4, which receive and support the eggs 5, supplied thereto by known means not shown, in the spaces between successive rollers to further advance the eggs. It is to be noted that the eggs 5 are supported by the roller chain with their acute ends facing at random in the one or the other direction. A moving belt 6 is arranged below the upper part of the roller chain 1 and engages the rollers of this upper chain part which belt 6 is driven against the direction of movement of the roller chain 1 whereby the rollers 4 in their advancing movement are also rotated about their axes. This causes the eggs 5 supported on two rollers 4 to be rotated about their longitudinal axes extending perpendicularly to their direction of forward movement and as a consequence of this rotation the eggs will also tend to move laterally in the direction of their acute ends in a manner well known in the art. Longitudinally extending vertical guide plates 7 are arranged above the roller chain 1, two adjacent guide plates 7 defining a track for the eggs moving between them which track has a greater width than the length of the eggs to be processed. The guide plates 7 thus limit the lateral displacement of the eggs rotating on the rollers 4 and each egg 5 before reaching the end of the roller chain 1 will have moved to a transverse position with its acute end contacting and sliding along the one or the other of the two partition plates 7 defining its track of movement as shown in FIG. 2. The above-described roller chain with rotating rollers and guide plates is as such well-known in the art, see for instance applicant's abovementioned U.S. patent application Ser. No. 504,526.

The apparatus comprises an upper frame 8, partly shown in FIG. 1, which supports the guide plates 7. An egg orienting member 9 is pivotally suspended from this upper frame 8 at the rear end thereof above the terminal pulley means 3 of the roller chain 1. In the embodiment of FIGS. 1-3 this orienting member 9 has a fork-shaped configuration comprising two downwardly extending legs or rods 10 of circular cross-section secured at their upper ends to a sleeve 11 mounted for free rotation on a transverse shaft 12. The shaft 12 extends through downwardly sloping slots 13 formed in extensions of the upper frame 8 and can be adjustably secured in these slots by conventional means allowing the orienting member 9 to be mounted in the desired position. As can be seen in FIG. 2, the orienting members 9 of the several parallel roller chain tracks can be pivotally mounted on a common shaft 12. FIG. 2 further shows that the two rods 10 of each orienting member are symmetrically arranged with respect to the central longitudinal plane through the roller chain track therebelow. Each rod 10 has an upper part 14 which, as seen in the side elevation of FIG. 1, extends from the sleeve 11 downwards and rearwards at an oblique angle while in the front elevation of FIG. 3 these upper rod parts 14 slightly diverge in the downward direction. The two rods 10 have sharp bends 15 connecting the upper rod parts 14 to lower rod parts 16 which in the side elevation of FIG. 1 extend downwards and forwards at an oblique angle and which in the front elevation of FIG. 3 converge in the downward direction. As shown in FIG. 1 by dotted lines the orienting member 9 has a rest position in which the bends 15 of the rods 10 rest against a stop member formed by a rod 17 extending transversely through the machine and being adjustably secured in horizontal mounting slots of slotted members 18 carried by the upper frame 8. In this rest position the downwardly extending rod parts 16 are situated at a short distance from the circular path followed by the rollers 4 of the roller chain 1 around the upper part of the terminal pulley means 3, the lower ends of the rod parts 16 terminating a short distance above the horizontal plane through the axis of the pulley means 3. The transverse spacing between the rod parts 16 at the level where the advancing eggs contact the orienting member 9 is such that first the acute end of the eggs sliding along the one or the other of the guide plates 7 will abut the rod 10 in front of it, whereas the blunt end of the egg at that moment will be still free of the other of the two rods 10. Below this level the spacing between the converging rod parts 16 decreases to a value smaller than the thickest part of the smallest of the eggs to be processed.

Figure 4:
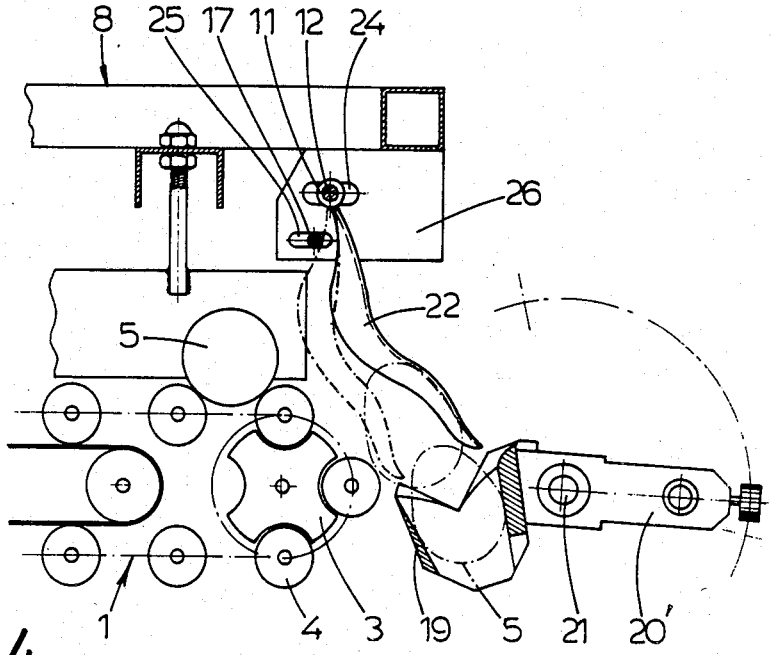
FIG. 4 is a similar longitudinal section as FIG. 1 of the apparatus having an orienting member according to a second preferred embodiment.

A receiving and transfer device for the eggs is arranged immediately downstream of the roller chain 1 which device may be of know design and may be adapted to deliver the eggs in the same oriented position to a conveyor belt of an egg grading machine or, for instance, immediately to suitable egg container means such as an egg tray as described in applicant's abovementioned U.S. patent application Ser. No. 504,526. In both cases the device may comprise a cup-shaped holder 19 which in its receiving position shown in FIG. 1 is situated with its front edge at the level of the axis of the star wheel 3 close to the path of the rollers 4 around this star wheel whereby the egg can easily be dropped into this holder. The holder 19 is carried by an arm 20 which in the embodiment shown can be rotated about its longitudinal axis for delivering the egg caught in the holder to a conveyor belt (not shown) advancing stepwise below the holder 19 in a transverse direction in a conventional manner well-known in the art. In the embodiment of FIG. 4, the holder 19 is secured to an arm 20′ which in this case is rotatably mounted on a shaft 21 allowing the arm 20′ to be rotated downwards for delivering the eggs caught in the holder 19 to an egg tray arranged therebelow as described in applicant's abovementioned patent application.

Figure 1A:
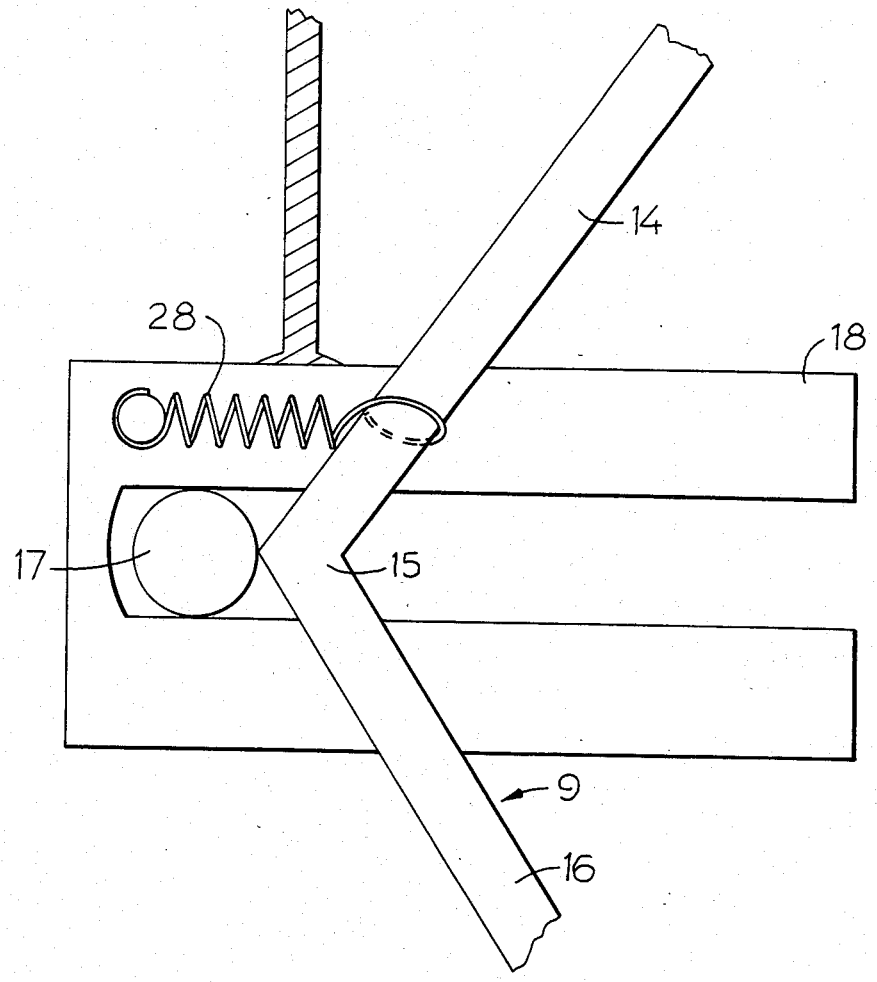
FIG. 1*a* is a blown up vertical section of a portion of an embodiment of the apparatus of the invention having spring means.

The above-described apparatus of FIGS. 1–3 operates as follows. When an egg 5 advanced by the roller chain 1 and sliding with its acute end along one of the guide plates 7 reaches the end of the roller chain 1, first this acute end portion of the egg laterally engages the one or the other of the two rods 10 of the pivotally mounted orienting member 9. At the same time the star wheel-shaped terminal pulley means 3 presses the egg radially, outwardly from its position between the supporting rollers 4. The acute end of the egg engaging said rod 10 of the orienting member 9 is thus to some extent restrained in its forward movement and this fact, together with the fact that the centre of gravity of the egg is closer to the blunt end than to the acute end of the egg, causes the egg to swing around through an angle of approximately 90° to a position in which its blunt end faces forwardly and downwardly thereby allowing the egg to slide downward by gravity into the cup 19 while being guided and centered in its falling movement by the lower rod parts 16 (as shown in FIG. 1 and with dotted lines in FIG. 2) and while lifting the orienting member 9 from its rest position to the fully drawn position of FIG. 1. This short falling movement is, furthermore, slowed down by the lower rod parts 16 engaging the egg on both sides thereof. By proper adjustment of the pivot shaft 12 and the stop shaft 17 the slope of the lower rod parts 16 can be selected for best results. Although it has been shown in practice that generally good results can be obtained by an orienting member 9 mounted for free rotation about its pivot shaft 12, it is nevertheless possible to use light spring means, such as spring 28 shown in FIG. 1*a*, to press this member against the stop rod 17.

Figure 5:
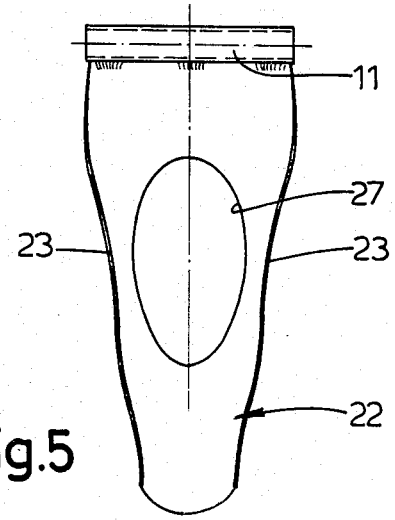
FIG. 5 is a front elevational view of the orienting member of the apparatus of FIG. 4.

The embodiment in FIGS. 4 and 5 differs from the embodiment in FIGS. 1–3 by an other configuration of the orienting member. In this case the orienting member is formed by a substantially spoon-shaped plate member 22 having turned-over side edge parts 23 facing the roller chain 1 and converging downwardly (FIG. 5) which side edges 23 have the same function as the guide rods 10 of the orienting member 9 of FIGS. 1–3. The plate member 22 is again secured to a sleeve 11 mounted for free rotation on a transverse pivot shaft 12. This shaft 12 and the stop rod 17 are horizontally adjustable in slots 24 and 25, respectively provided in parts 26 of the upper frame 8. In this embodiment the advancing eggs when meeting the one or the other of the side edge parts 23 of the plate member 22 are swung around in a similar way as above described for the orienting member 9 and are then received in the hollow of the plate member 22 between the side edge parts 23 thereof and are guided downwardly thereby (FIG. 4), the plate member 22 causing a somewhat greater braking of the falling movement of the eggs as compared to the orienting member 9 of FIGS. 1–3. The preferred configuration of the plate member 22 in side elevation is shown in FIG. 4 but a somewhat different plate profile would also be possible. As shown in FIG. 5, the body of the plate member 22 may have an opening 27 cut out therein.

While the invention has been illustrated and described with reference to specific embodiments thereof, it will be understood that other embodiments may be resorted to within the scope of the following claims.

What is claimed is:

1. An egg handling system, comprising:

means for supplying and conveying eggs in a continuous row along a track with said eggs all in a position with their longitudinal axes extending horizontally and perpendicularly to the direction of forward movement of the eggs, said track having a terminal end where the eggs leave said track;

receiving means, disposed just beyond and beneath said terminal end of said track, adapted for receiving eggs with their blunt ends substantially downward;

a single integral member pivotally arranged at the end of said track for conducting successively, in cooperation with said track terminal end, said eggs from said track to said receiving means, such that said eggs while being conducted by said member are both aligned with their blunt ends facing generally forwardly in the direction of their movement and oriented with their blunt ends facing substantially downwardly in the direction of said receiving means; wherein said pivoting integral member comprises a single elongate egg aligning and orienting member disposed at the downstream end of said track, said member having its upper end pivotally mounted above and even with or just upstream of said track terminal end, and having a downwardly extending lower portion; and said system further comprising means for determining a rest position for said pivoting integral member in which said lower portion thereof extends from above said track terminal end to substantially obliquely forwardly and downwardly across and spaced from said track terminal end so that the tip of said pivoting integral member is relatively adjacent said receiving means to aid in conducting eggs thereto; and wherein said pivoting integral member is mounted to be swung upwardly from said rest position by said eggs; and further wherein said pivoting integral member has two guide edges extending longitudinally for at least the lower portion thereof and facing said track terminal end; and said guide edges, at an area above and just upstream of said track terminal end where advancing eggs first engage said pivoting integral member, having a lateral spacing and position such that each egg is initially engaged adjacent its acute end by one of said two guide edges while the blunt end of such egg is instead permitted to slide downwards along said track terminal end in a single, continuous movement thereof along the other one of said guide edges for simultaneous downward orientation of the egg as the egg swings around for defined alignment thereof during said single-movement downward-sliding of same to a position in said receiving means in which its blunt end faces generally forwardly in said direction of forward movement and is substantially oriented downwards in the direction of said receiving means; said guide edges converging downwardly near said receiving means to a fixed relative lateral spacing which is smaller than the thickest part of said eggs so that said pivoting integral member remains substantially on the upper part of said eggs, which smaller lateral spacing guides and centers said eggs directly into said receiving means; whereby said eggs are aligned and oriented by a single, integral pivoting member while being conducted thereby from said track terminal end to said receiving means.

2. A system as in claim 1, further including means for pivotally mounting the upper end of said pivoting integral member and wherein such pivot means of said pivoting integral member is adjustable in a horizontal direction.

3. A system as in claim 1, wherein said means determining said rest position of said pivoting integral member comprises a stop for said pivoting integral member which is adjustable in a horizontal direction.

4. A system as in claim 1, wherein said pivoting integral member is substantially fork-shaped and comprises two guide rod members forming said guide edges thereof.

5. A system as in claim 4, wherein said two rod members have lower egg engaging portions extending downwardly at an angle of substantially 45° to the vertical in said rest position of said pivoting integral member.

6. A system as in claim 1, wherein said pivoting integral member comprises a plate member of substantially spoon-like configuration having turned-over side edge parts to form said guide edges thereof.

7. A system as in claim 6, wherein said plate member defines an opening cut-out in the body thereof.

8. A system as in claim 1, further comprising spring means for urging said pivoting integral member towards said rest position thereof.

9. An apparatus for aligning and orienting eggs in a single movement by a single integral member, said apparatus comprising:

egg conveying means including a driven endless roller chain having a plurality of equally spaced rollers adapted to support successive eggs therebetween, and means for rotating said rollers about their axes to provide lateral movement of eggs while said chain advances said eggs, said roller chain passing downwards around terminal pulley means for supporting said chain at its downstream end, egg receiving and transferring means, located downstream from and just beneath said terminal pulley means, adapted for receiving eggs from said egg conveying means with their blunt ends oriented substantially downward and aligned slightly in the direction of their forward movement, and for subsequently handling same, at least one pair of parallel longitudinally extending vertical guide plates arranged above said roller chain and defining therebetween a track for said eggs, said track being of a given width greater than the length of the eggs to be oriented, and said guide plates limiting said lateral movement of eggs in one or the other direction caused by said rotation of said rollers, a single integral elongate egg aligning and orienting member arranged at the downstream end of said track, said integral member being pivotally mounted at its upper end above said roller chain terminal pulley means and having a downwardly extending lower portion defined below a bend in said integral member, and slidable stop means for slidably adjusting to determine a rest position for said integral member in which said lower portion thereof extends substantially obliquely forwardly and downwardly and spaced from the downward course of said rollers about said pulley means and in the path of the eggs in said track, said integral member being free to pivot upwardly and outwardly from said rest position in response to contact with an egg descending from said egg conveying means along said terminal pulley means to said egg receiving and transferring means, wherein said lower portion of said integral member comprises two guide edges facing said roller chain with a predetermined lateral spacing and position at a level where advancing eggs first meet said integral member such that each egg is initially engaged adjacent only its acute end by one of said two guide edges while the blunt end of the egg is caused to rotate for alignment so as to face in the direction of forward movement of said eggs as such egg is simultaneously permitted to slide downwards along the other one of said guide edges, as said integral member is pivoted upward from said rest position thereof, for orientation such that the egg is positioned with its blunt end facing substantially downwards, whereby said eggs are aligned and oriented with one single, continuous movement of said integral member and conducted thereby from said egg conveying means to said egg receiving and transferring means; and wherein said guide edges converge towards their ends to a fixed relative lateral spacing which is smaller than the thickest part of said eggs to be aligned and oriented so that said integral member remains substantially on the upper part of said eggs, such relative smaller lateral spacing guiding and centering eggs into said receiving and transferring means.

10. The apparatus of claim 9 in which said integral member is substantially fork-shaped and comprises two guide rod members forming said guide edges.

11. The apparatus of claim 10 in which said two rod members have lower egg engaging portions extending downwardly at an angle of substantially 45° to the vertical in said rest position of said integral member.

12. The apparatus of claim 9 in which said integral member comprises a plate member of substantially spoon-like configuration having turned-over side edge parts to form said guide edges.

13. The apparatus of claim 12 further comprising an opening cut-out in the body of said plate member.

14. The apparatus of claim 9 in which said terminal pulley means comprises projections engaging between said successive rollers of said roller chain so as to lift the eggs from their positions supported between said rollers.

15. The apparatus of claim 9 further comprising means for receiving said eggs as oriented by said integral member, said receiving means including at least one cup-shaped holder adapted to receive a single egg, said holder having an upper edge and being mounted for movement between an egg receiving position and an egg discharging position, said holder in its egg receiving position having a portion of its upper edge situated at the level of the axis of said terminal pulley means and close to the path of said rollers of said roller chain about said pulley means.

16. An egg handling system, comprising:

means for supplying and conveying eggs in a continuous row along a track with said eggs all in a position with their longitudinal axes extending horizontally and perpendicularly to the direction of forward movement of the eggs, said track having a terminal end where the eggs leave said track;

means arranged at the end of said track for successively aligning and orienting said eggs with their blunt ends facing in the direction of forward movement;

means for receiving said aligned and oriented eggs; wherein said aligning and orienting means comprise a single elongate egg aligning and orienting member arranged at the downstream end of said track, said aligning and orienting member having its upper end pivotally mounted above said track end and having a downwardly extending lower portion; and said system further comprises means for determining a rest position for said aligning and orienting member in which said lower portion thereof extends substantially obliquely forwardly and downwardly across and spaced from said track end; and wherein said aligning and orienting member is free to swing upwardly from said rest position; said lower portion of said aligning and orienting member comprises two guide edges facing said track end; said guide edges, at the level where the advancing eggs first meet said member, having a lateral spacing and position such that each egg is initially engaged adjacent its acute end by one of said two guide edges while the blunt end of the egg is instead permitted to slide downwards in a single, continuous movement thereof along the other one of said guide edges for simultaneous orientation of the egg as the egg swings around for alignment during said single-movement downward sliding of same to a position in which its blunt end faces in said direction of forward movement and is thus simultaneously oriented downwards; said guide edges converging downwardly to a fixed relative lateral spacing which is smaller than the thickest part of said eggs to be aligned and oriented; wherein said aligning and orienting member comprises a plate member of substantially spoon-like configuration having turned-over side edge parts to form said guide edges.

* * * * *